US007350363B2

(12) United States Patent
Stautner et al.

(10) Patent No.: US 7,350,363 B2
(45) Date of Patent: Apr. 1, 2008

(54) PULSE TUBE REFRIGERATOR SLEEVE

(75) Inventors: Wolfgang Stautner, Oxford (GB); Florian Steinmeyer, Oxon (GB)

(73) Assignee: Siemens Magnet Technology, Ltd., Eynsham (GB)

( * ) Notice: Subject to any disclaimer, the term of this patent is extended or adjusted under 35 U.S.C. 154(b) by 286 days.

(21) Appl. No.: 10/492,941

(22) PCT Filed: Oct. 21, 2002

(86) PCT No.: PCT/EP02/11815

§ 371 (c)(1),
(2), (4) Date: Oct. 19, 2004

(87) PCT Pub. No.: WO03/036207

PCT Pub. Date: May 1, 2003

(65) Prior Publication Data

US 2005/0103025 A1 May 19, 2005

(30) Foreign Application Priority Data

Oct. 19, 2001 (GB) ..... 0125188.3

(51) Int. Cl.
*F25B 9/00* (2006.01)
*F25B 19/00* (2006.01)

(52) U.S. Cl. ..... 62/6; 62/51.1

(58) Field of Classification Search ..... 62/6, 62/51.1

See application file for complete search history.

(56) References Cited

U.S. PATENT DOCUMENTS 4,995,237 A * 2/1991 Strasser ..... 62/93
5,107,683 A 4/1992 Chan et al.
5,111,665 A * 5/1992 Ackermann ..... 62/6
5,412,952 A 5/1995 Ohtani et al.
5,583,472 A * 12/1996 Moritsu et al. ..... 335/216
5,647,219 A 7/1997 Rattray et al.
5,657,634 A * 8/1997 Woods ..... 62/51.1
5,680,768 A 10/1997 Rattray et al.

(Continued)

FOREIGN PATENT DOCUMENTS

EP 0 717 245 A 6/1996

(Continued)

*Primary Examiner*—William C Doerrler
(74) *Attorney, Agent, or Firm*—Crowell & Moring LLP

(57) ABSTRACT

The present invention relates to pulse tube refrigerators for recondensing cryogenic liquids. In particular, the present invention relates to the same for magnetic resonance imaging systems. In many cryogenic applications components, e.g. superconducting coils for magnetic resonance imaging (MRI), superconducting transformers, generators, electronics, are cooled by keeping them in contact with a volume of liquified gases (e.g. Helium, Neon, Nitrogen, Argon, Methane . . . ). Any dissipation in the components or heat getting into the system causes the volume to part boil off. To account for the losses, replenishment is required. This service operation is considered to be problematic by many users and great efforts have been made over the years to introduce refrigerators that recondense any lost liquid right back into the bath. The present invention addresses the problems arising from convection which occurs within a pulse tube refrigerator. The invention provides. in a first aspect, a PTR recondenser wherein, the individual tubes of PTR are insulated by a split sleeve around the whole assembly. Preferably, the sleeve is split into two parts. This configuration has been shown to reduce convection and problems associated therewith.

14 Claims, 12 Drawing Sheets

U.S. PATENT DOCUMENTS

| | | | | |
|---|---|---|---|---|
| 5,735,127 | A * | 4/1998 | Pfotenhauer et al. | 62/6 |
| 5,904,046 | A | 5/1999 | Kawano | |
| 5,918,470 | A * | 7/1999 | Xu et al. | 62/51.1 |
| 6,164,077 | A * | 12/2000 | Feger | 62/6 |
| 6,192,690 | B1 * | 2/2001 | Stautner | 62/6 |
| 6,438,966 | B1 * | 8/2002 | Sarwinski et al. | 62/6 |
| 2002/0002830 | A1 * | 1/2002 | Strobel et al. | 62/51.2 |

FOREIGN PATENT DOCUMENTS

| | | | |
|---|---|---|---|
| EP | 0 781 956 | A | 7/1997 |
| EP | 0 905 435 | A | 3/1999 |
| EP | 0 905 436 | A | 3/1999 |
| EP | 0 905 524 | A | 3/1999 |
| EP | 1158256 | A1 | 7/2006 |
| FR | 2 743 871 | A | 7/1997 |
| GB | 2 180 632 | A | 4/1987 |
| GB | 2 310 486 | A | 8/1997 |
| GB | 2 329 701 | A | 3/1999 |
| GB | 2 330 194 | A | 4/1999 |
| JP | 2000 018744 | A | 1/2000 |

* cited by examiner

Prior Art

PULSE TUBE REFRIGERATOR SLEEVE

FIELD OF THE INVENTION

The present invention relates to pulse tube refrigerators for recondensing cryogenic liquids. In particular, the present invention relates to the same for magnetic resonance imaging systems.

BACKGROUND TO THE INVENTION

In many cryogenic applications components, e.g. superconducting coils for magnetic resonance imaging (MRI), superconducting transformers, generators, electronics, are cooled by keeping them in contact with a volume of liquefied gases (e.g. Helium, Neon, Nitrogen, Argon, Methane). Any dissipation in the components or heat getting into the system causes the volume to part boil off. To account for the losses, replenishment is required. This service operation is considered to be problematic by many users and great efforts have been made over the years to introduce refrigerators that recondense any lost liquid right back into the bath.

As an example of prior art, an embodiment of a two stage Gifford McMahon (GM) coldhead recondenser of an MRI magnet is shown in FIG. 1. In order for the GM coldhead, indicated generally by 10, to be removable for service or repair, it is inserted into a sock, which connects the outside face of a vacuum vessel 16 (at room temperature) to a helium bath 18 at 4K. MRI magnets are indicated at 20. The sock is made of thin walled stainless steel tubes forming a first stage sleeve 12, and a second stage sleeve 14 in order to minimize heat conduction from room temperature to the cold end of the sock operating at cryogenic temperatures. The sock is filled with helium gas 30, which is at about 4.2K at the cold end and at room temperature at the warm end. The first stage sleeve 12 of the coldhead is connected to an intermediate heat station of the sock 22, in order to extract heat at an intermediate temperature, e.g. 40K-80K, and to which sleeve 14 is also connected. The second stage of the coldhead 24 is connected to a helium gas recondenser 26. Heat arises from conduction of heat down through the neck, heat radiated from a thermal radiation shield 42 as well as any other sources of heat for example, from a mechanical suspension system for the magnet, (not shown) and from a service neck (also not shown) used for filling the bath with liquids, instrumentation wiring access, gas escape route etc. A radiation shield 42 is placed intermediate the helium bath and the wall of the outer vacuum vessel.

The second stage of the coldhead is acting as a recondenser at about 4.2K. As it is slightly colder than the surrounding He gas, gas is condensed on the surface (which can be equipped with fins to increase surface area) and is dripped back into the liquid reservoir. Condensation locally reduces pressure, which pulls more gas towards the second stage. It has been calculated that there are hardly any losses due to natural convection of Helium, which has been verified experimentally provided that the coldhead and the sock are vertically oriented (defined as the warm end pointing upwards). Any small differences in the temperature profiles of the Gifford McMahon cooler and the walls would set up gravity assisted gas convection, as the density change of gas with temperature is great (e.g. at 4.2. K the density is 16 $kg/m^3$; at 300 K the density is 0.16 $kg/m^3$). Convection tends to equilibrate the temperature profiles of the sock wall and the refrigerator. The residual heat losses are small. FIG. 1A shows a corresponding view without coldhead 32, 34 in place. In greater detail, the intermediate section 22 shows a passage 38 to enable helium gas to flow from the volume encircled by sleeve 14. The latter volume is also in fluid connection with the main bath 36 in which the magnet 20 is placed. Also shown is a flange 40 associated with sleeve 12 to assist in attaching the sock to the vacuum vessel 16.

When the arrangement is tilted, natural convection sets up huge losses. A solution to this problem has been described in U.S. Patent, U.S. Pat. No. 5,583,472, to Mitsubishi. Nevertheless, this will not be further discussed here, as this document relates to arrangements which are vertically oriented or at small angles (<30°) to the vertical.

It has been shown that Pulse Tube Refrigerators (PTRs) can achieve useful cooling at temperatures of 4.2K (the boiling point of liquid helium at normal pressure) and below (C. Wang and P. E. Gifford, Advances in Cryogenic Engineering, 45, Edited by Shu et a., Kluwer Academic/Plenum Publishers,2000, pp.1-7). Pulse tube refrigerators are attractive, because they avoid any moving parts in the cold part of the refrigerator, thus reducing vibrations and wear of the refrigerator. Referring now to FIG. 2, there is shown a PTR 50 comprising an arrangement of separate tubes, which are joined together at heat stations. There is one regenerator tube 52, 54 per stage, which is filled with solid materials in different forms (e.g. meshes, packed spheres, powders), that act as heat buffer and exchange heat with the working fluid of the PTR (usually He gas at a pressure of 1.5-2.5 MPa). There is one pulse tube 56, 58 per stage, which is hollow and used for expansion and compression of the working fluid. In two stage PTRs, the second stage pulse tube 56 usually links the second stage 60 with the warm end 62 at room temperature, the first stage pulse tube 58 linking the first stage 64 with the warm end.

It has been found, that PTRs operating in vacuum under optimum conditions usually develop temperature profiles that are significantly different across the tubes and also from what would be a steady state temperature profile in a sock. This is shown in FIG. 3.

Another prior art pulse tube refrigerator arrangement is shown in FIG. 4 wherein a pulse tube is inserted into a sock, and is exposed to a helium atmosphere wherein gravity induced convection currents 70, 72 are set up in the first and second stages. The PTR unit 50 is provided with cold stages 31, 33 which are set in a recess in an outer vacuum container 16. A radiation shield 42 is provided which is in thermal contact with first sleeve end 22. A recondenser 26 is shown on the end wall of second stage 33. If at a given height the temperatures of the different components are not equal, the warmer components will heat the surrounding helium, giving it buoyancy to rise, while at the colder components the gas is cooled and drops down. The resulting thermal losses are huge, as the density difference of helium gas at 1 bar changes by a factor of about 100 between 4.2 K and 300 K. The net cooling power of a PTR might be e.g. 40 W at 50 K, and 0.5 W to 1 W at 4.2K. The losses have been calculated to be of the order of 5-20 W. The internal working process of a pulse tube will, in general, be affected although this is not encountered in GM refrigerators. In a PTR, the optimum temperature profile in the tubes, which is a basis for optimum performance, arises through a delicate process balancing the influences of many parameters, e.g. geometries of all tubes, flow resistivities, velocities, heat transfer coefficients, valve settings etc. (A description can be found in Ray Radebaugh, proceedings of the $6^{th}$ International Cryogenic Engineering Conference, Kitakkyushu, Japan, 20-24 May 1996, pp22-44).

Therefore, in a helium environment, PTRs do not necessarily reach temperatures of 4 K., although they are capable of doing so in vacuum. Nevertheless, if the PTR is inserted in a vacuum sock with a heat contact to 4K through a solid wall, it would work normally. Such a solution has been described for a GM refrigerator (US Patent U.S. Pat. No. 5,613,367 to William E. Chen, GE) although the use of a PTR would be possible and be straightforward. The disadvantage, however, is that the thermal contact of the coldhead at 4K would produce a thermal impedance, which effectively reduces the available power for refrigeration. As an example, with a state of the art thermal joint made from an Indium washer, a thermal contact resistance of 0.5 K/W can be achieved at 4 K (see e.g. U.S. Pat. No. 5,918,470 to GE). If a cryocooler can absorb 1 W at 4.2K (e.g. the model RDK 408 by Sumitomo Heavy Industries) then the temperature of the recondenser would rise to 4.7K, which would reduce the current carrying capability of the superconducting wire drastically. Alternatively, a stronger cryocooler would be required to produce 1 W at 3.7 K initially to make the cooling power available on the far side of the joint.

FIG. 5 shows an example of such a PTR arrangement 76. The component features are substantially the same as showed in FIG. 4. Thermal washer 78 is provided between the second stage of the PTR coldhead and a finned heat sink 80. A helium-tight wall is provided between the thermal washer and the heat sink.

OBJECT OF THE INVENTION

The present invention seeks to provide an improved pulse tube refrigerator.

STATEMENT OF THE INVENTION

In accordance with a first aspect of the invention, there is provided a pulse tube refrigerator PTR arrangement within a cryogenic apparatus, wherein a PTR is operable within an insertion sock associated with a housing of the cryogenic apparatus for the placement of the PTR such that a first end is exposed to room temperature and a second end is associated with a cryogenic fluid, wherein the insertion sock comprises an inner sleeve and an outer sleeve, wherein the tubes of the PTR are surrounded by the inner sleeve and wherein the tubes of the PTR and the inner sleeve are separable as a unit from the outer sleeve. Preferably, the sleeve is spilt into first and second parts, wherein the first part covers a region from a warm end to a first stage, the second part, preferably of a smaller diameter, extends between the first and a second stage at the cold end. Conveniently, the insertion sock comprises an access part in an outer vacuum wall of a PTR arrangement to form a sock, as is known, and the second sleeve comprises an innet sleeve (inner sock) which surrounds all the tubes of the pulse tube, leaving only a small annular gap between the sleeve and the sock wall. The sleeves can be fabricated from the same or different materials such as thin gauge stainless tube or other suitable materials like titanium, composites like GRP, CFRP, possibly with metallic liners to make them diffusion proof against helium leakage. Preferably the space between the second sleeve, and the PTR tubes is evacuated inside whereby to reduce heat transfer by convection. A sleeve can be joined by conventional joining techniques like welding or brazing to the flanges.

The additional heat load arising from conduction associated with the additional wall can be partially compensated for by reducing the heat conduction due to a static helium column. Such a helium column can introduce a 1-2 W heat loss without taking any convection into account. In a two-stage split assembly, the first and second part can usually be joined by a through passage in the first stage to make a single volume for ease of evacuation.

Thus, the present invention enables problems associated with convection in a PTR to be substantially reduced or overcome without compromising heat transfer at the second stage by the introduction of a thermal contact or similar which are known to impede heat transfer characteristics.

BRIEF DESCRIPTION OF THE FIGURES

The invention may be understood more readily, and various other aspects and features of the invention may become apparent, from consideration of the following description and the figures as shown in the accompanying drawing sheets, wherein.

DETAILED DESCRIPTION OF THE INVENTION

There will now be described, by way of example, the best mode contemplated by the inventors for carrying out the invention. In the following description, numerous specific details are set out in order to provide a complete understanding of the present invention. It will be apparent, however, to those skilled in the art, that the present invention may be put into practice with variations from the specific details.

Figure 1:
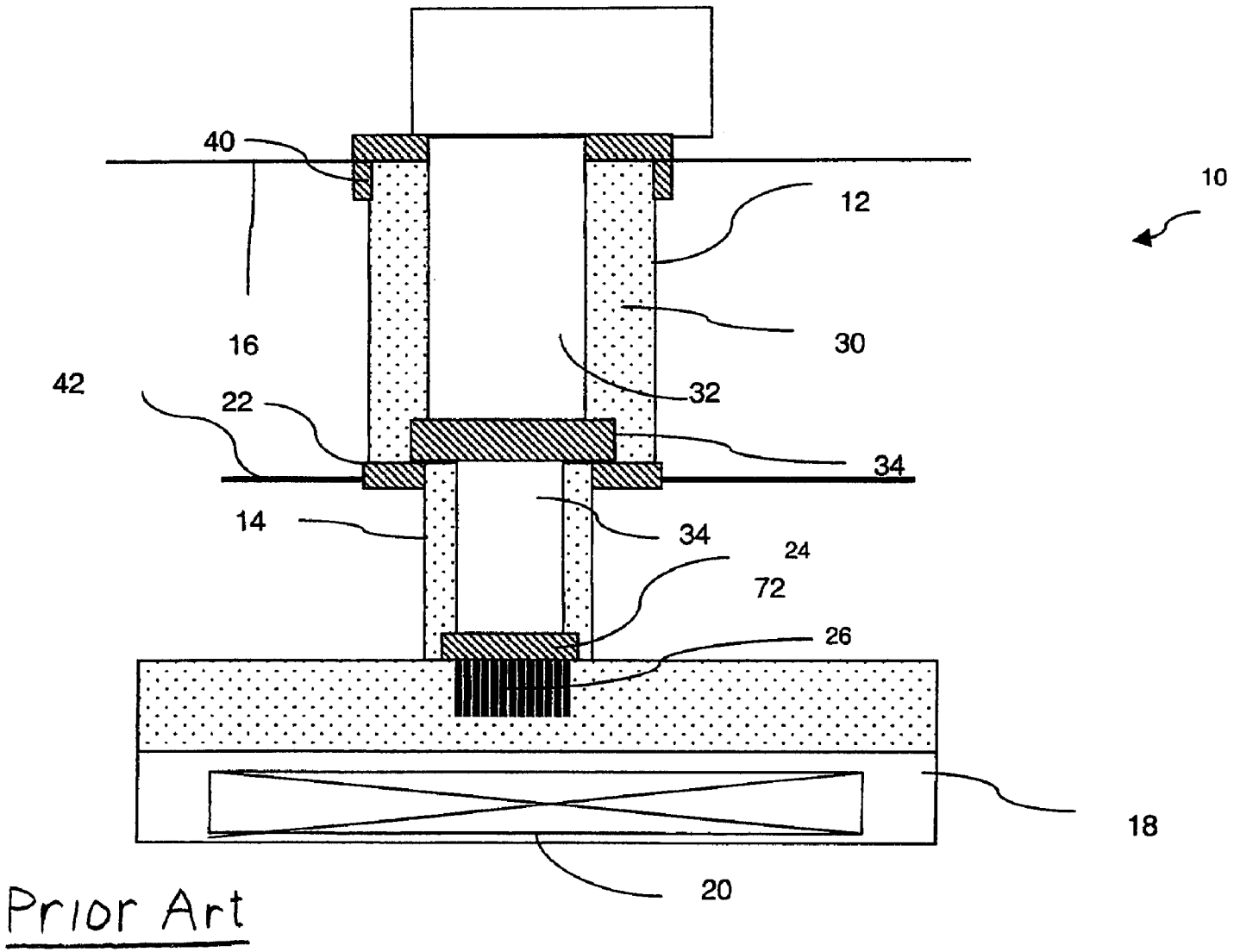
FIG. 1 shows a two stage Gifford McMahon coldhead recondenser in a MRI magnet.
Figure 1A:
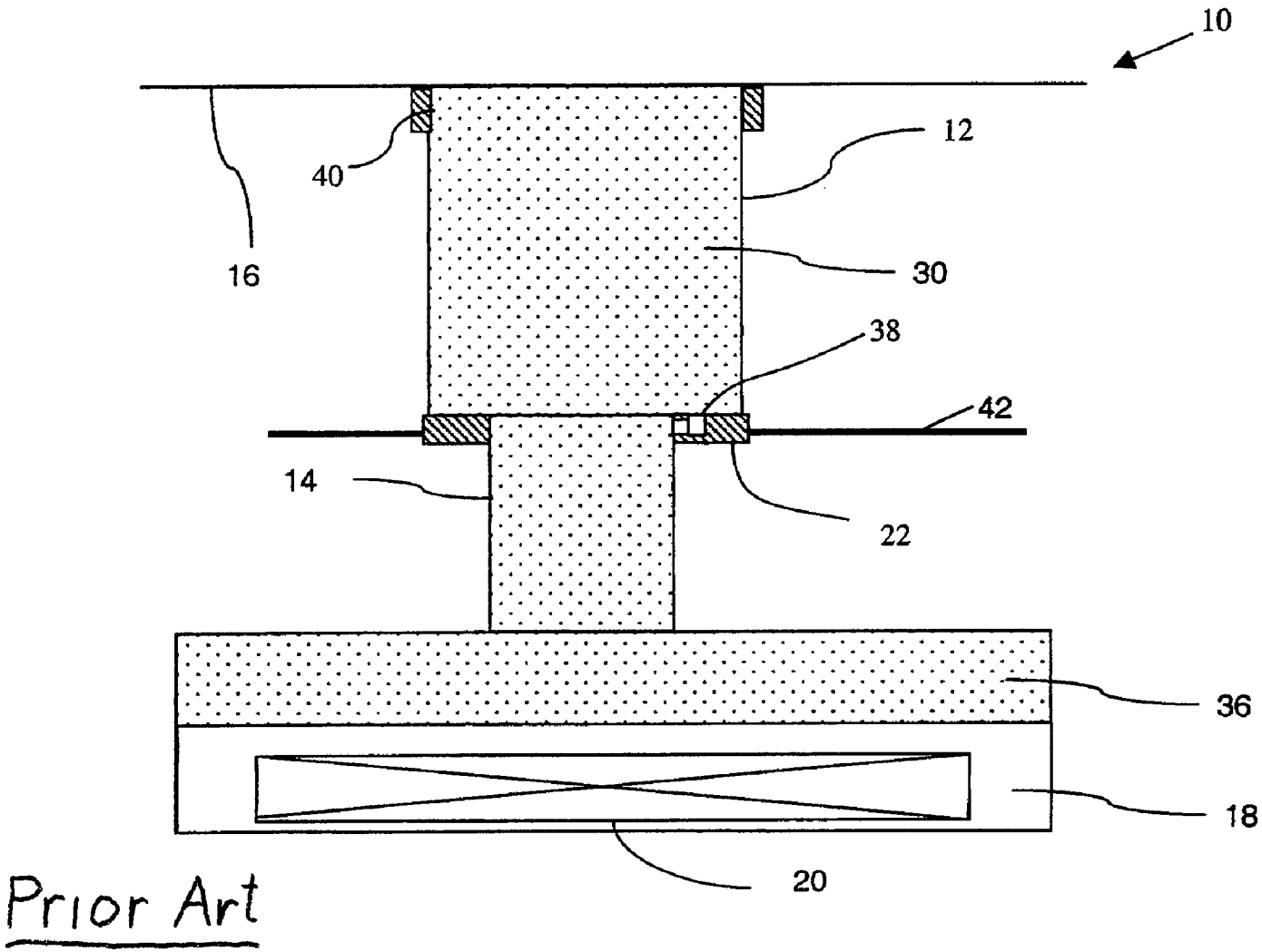
FIG. 1A shows the recondenser of FIG. 1 without the recondenser tubes.
Figure 2:
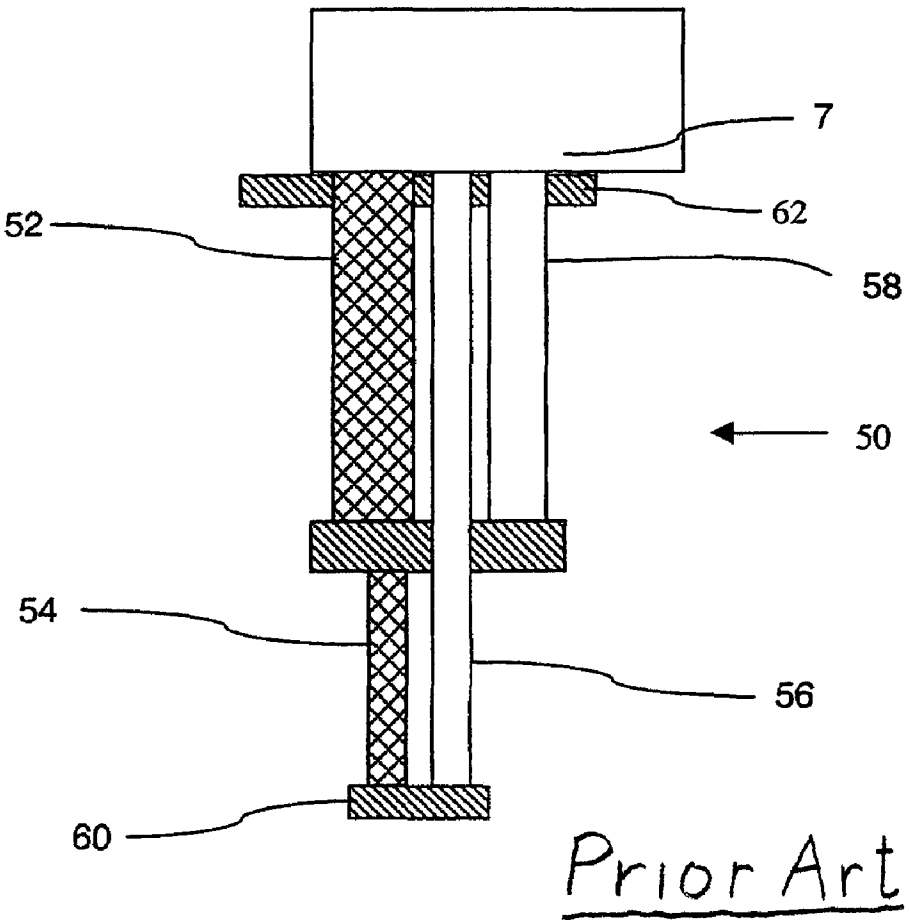
FIG. 2 shows a dual stage PTR.
Figure 3:
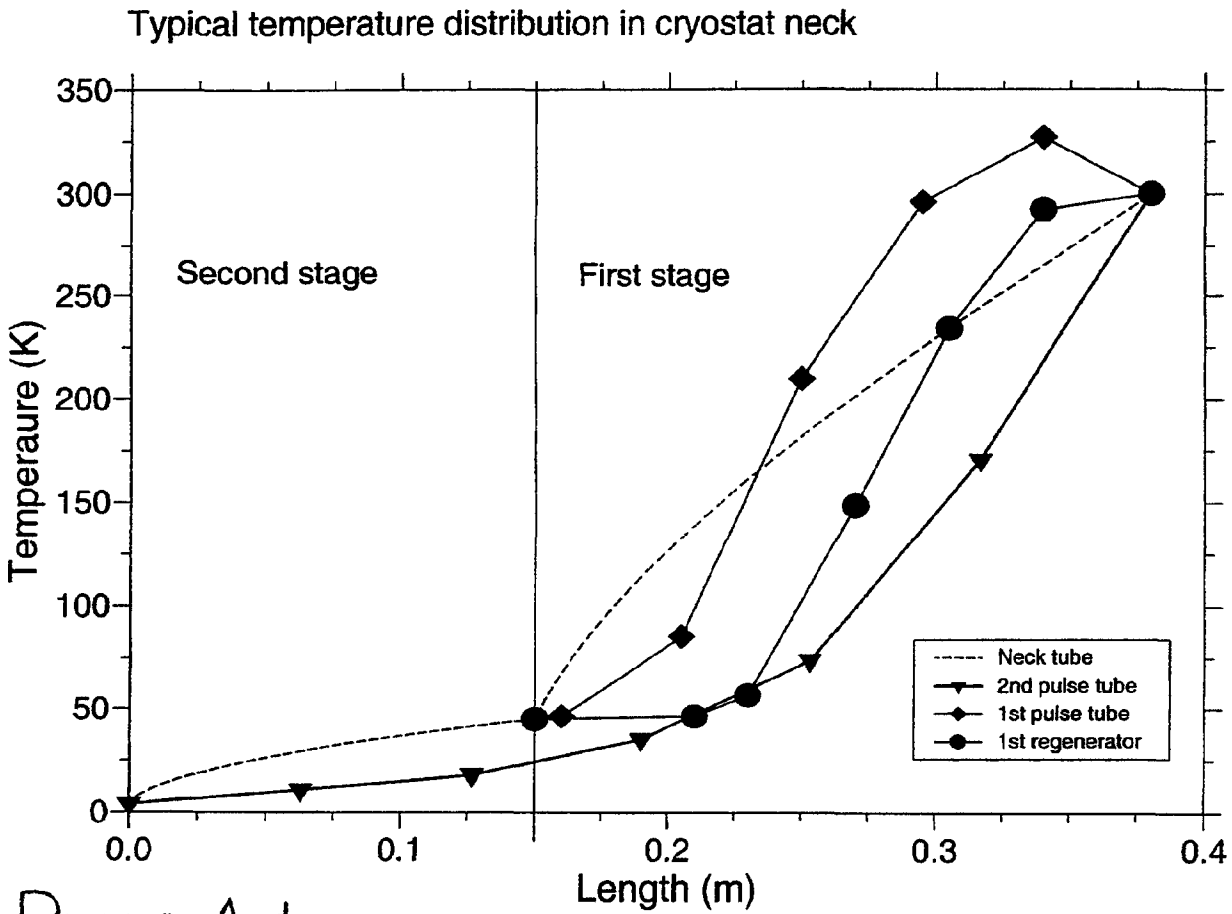
FIG. 3 shows a temperature profile of elements within a sock.
Figure 4:
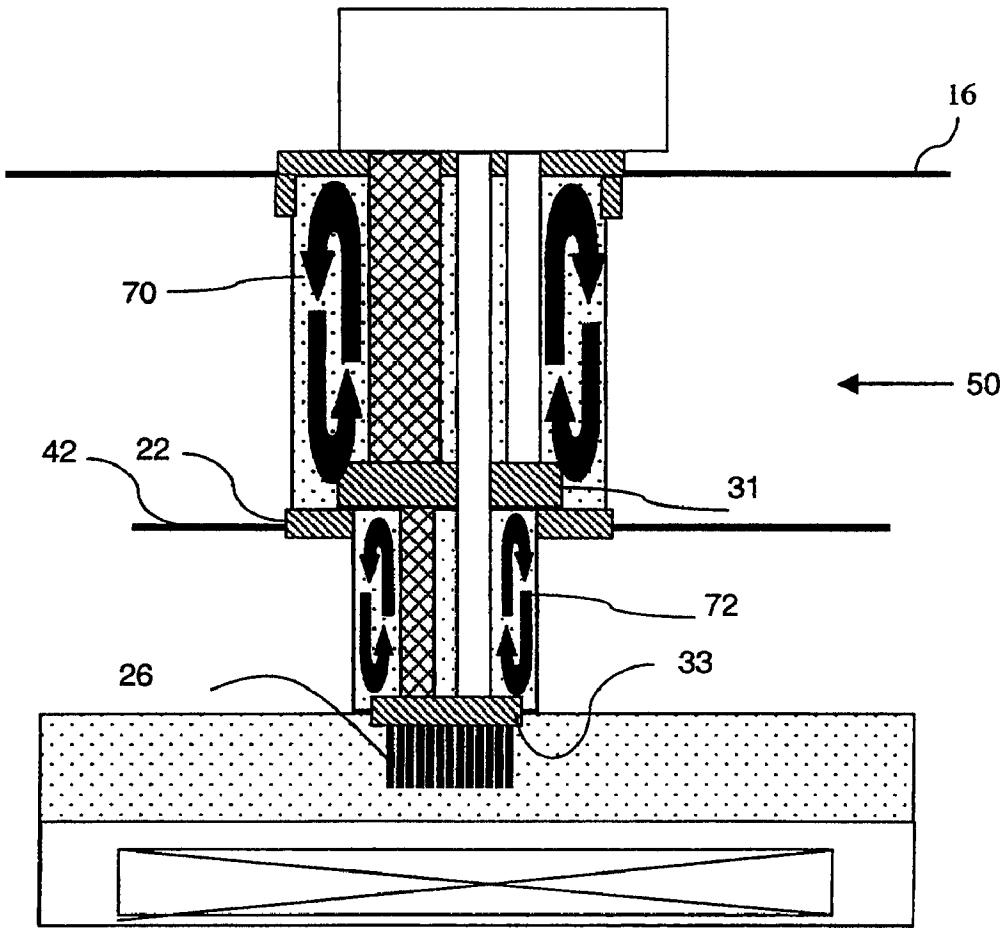
Prior Art Fig 4
FIG. 4 shows a pulse tube inserted into a sock.
Figure 5:
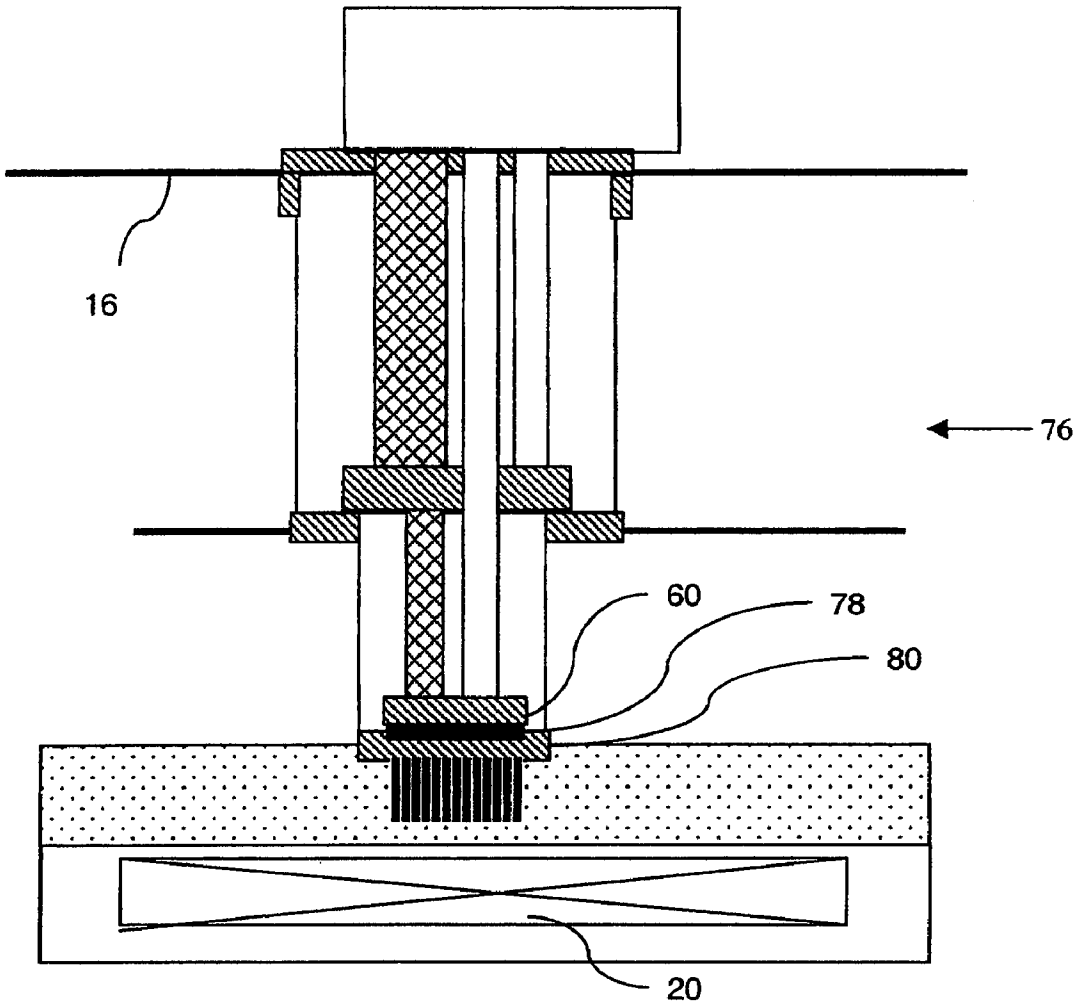
Prior Art Fig. 5
FIG. 5 shows a prior art example of a pulse tube with a removable thermal contact.
Figure 6:
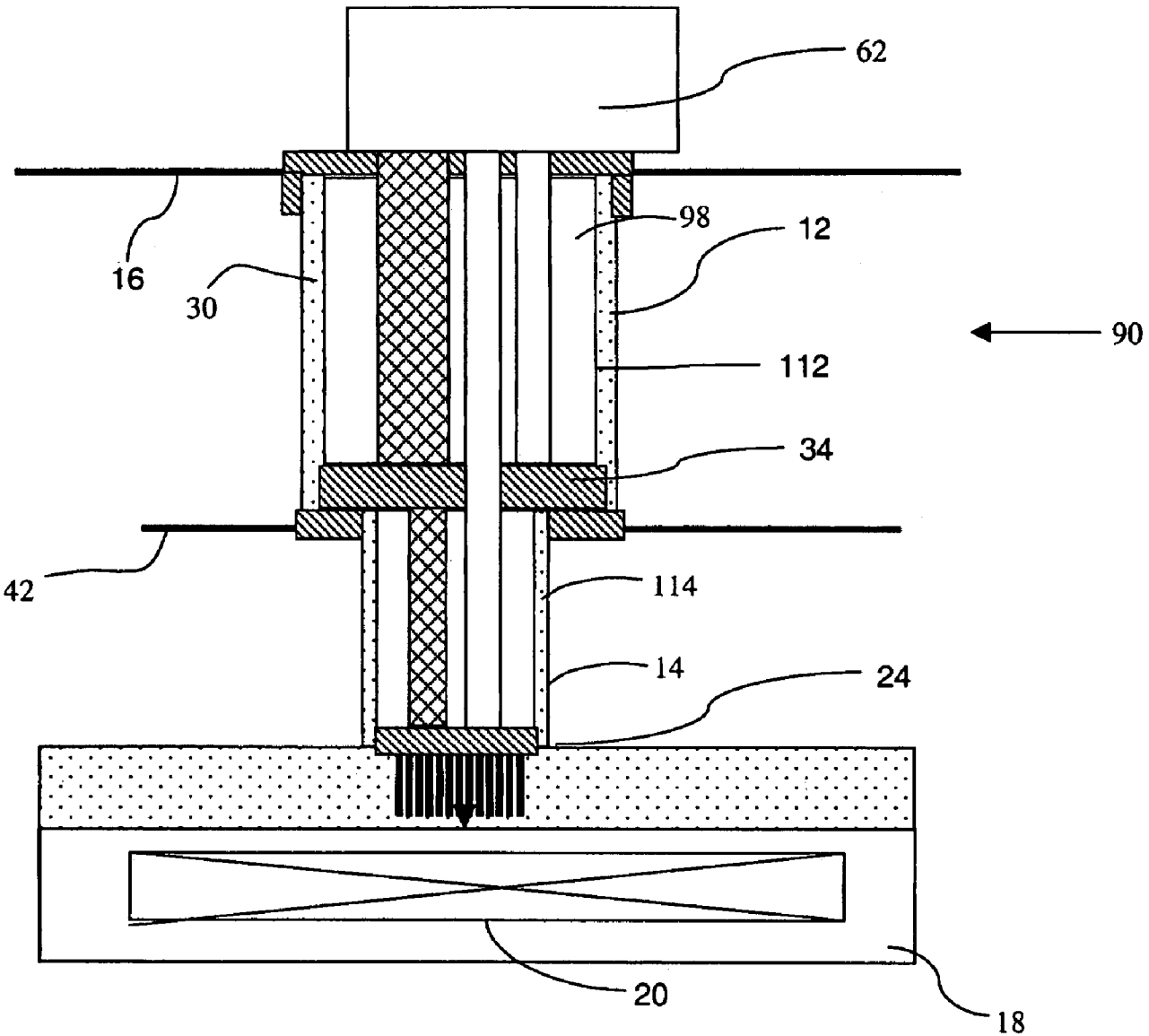
FIG. 6 shows a PTR in accordance with the present invention.

Referring now to FIG. 6, there is shown a first embodiment of the invention: there is provided a PTR 90 having individual tubes of the PTR being insulated by a dual sleeve assembly 12, 112; 14, 114 around the PTR tubes between the warm end of the PTR coldhead 62 and the first stage 34 and between the first stage 34 and the second stage 24.

Figure 6A:
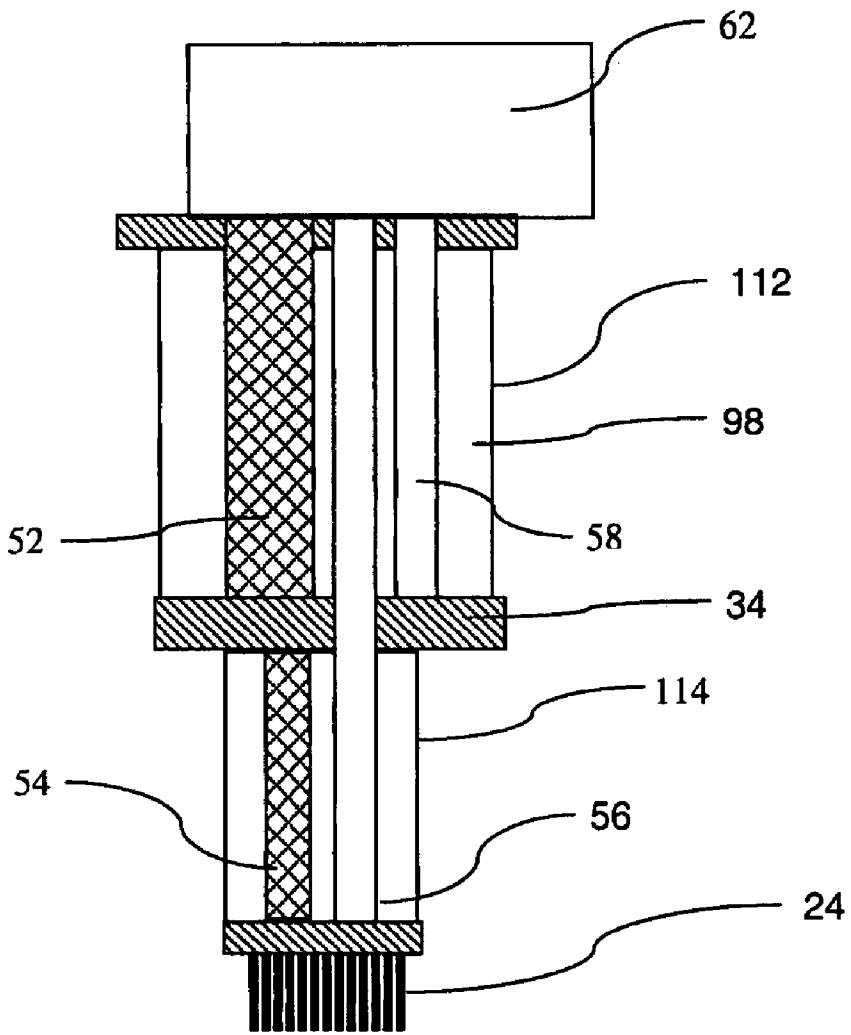
FIG. 6A shows the PTR of FIG. 6 without the outer sock.

The second stage sleeve can be of a reduced diameter with respect to the first stage sleeve. The sleeve walls 12, 14, 112, 114 can be double walled and may be evacuated during manufacture by joining them in a vacuum process, e.g. vacuum brazing or electron beam welding. In such cases, no separate evacuation process is required, no ports are fitted and a minimum complexity of parts is achieved. Alternatively, in another form, pump-out can be achieved after manufacture by fitting a separate evacuation port (not shown). The sleeve surrounds all the tubes of the arrangement, leaving only a small annular gap therebetween. The outer wall of the vacuum vessel of the magnet apparatus is shown by reference numeral 16; the magnet is indicated by reference numeral 20 in a helium bath having a wall 74. A radiation shield 42 is attached by way of a thermal contact 22 to the first stage 34. As mentioned earlier, there is a finned helium recondenser 76. FIG. 6A shows the arrangement of FIG. 6 without the outer sock and components outside the outer sock.

Figure 7:
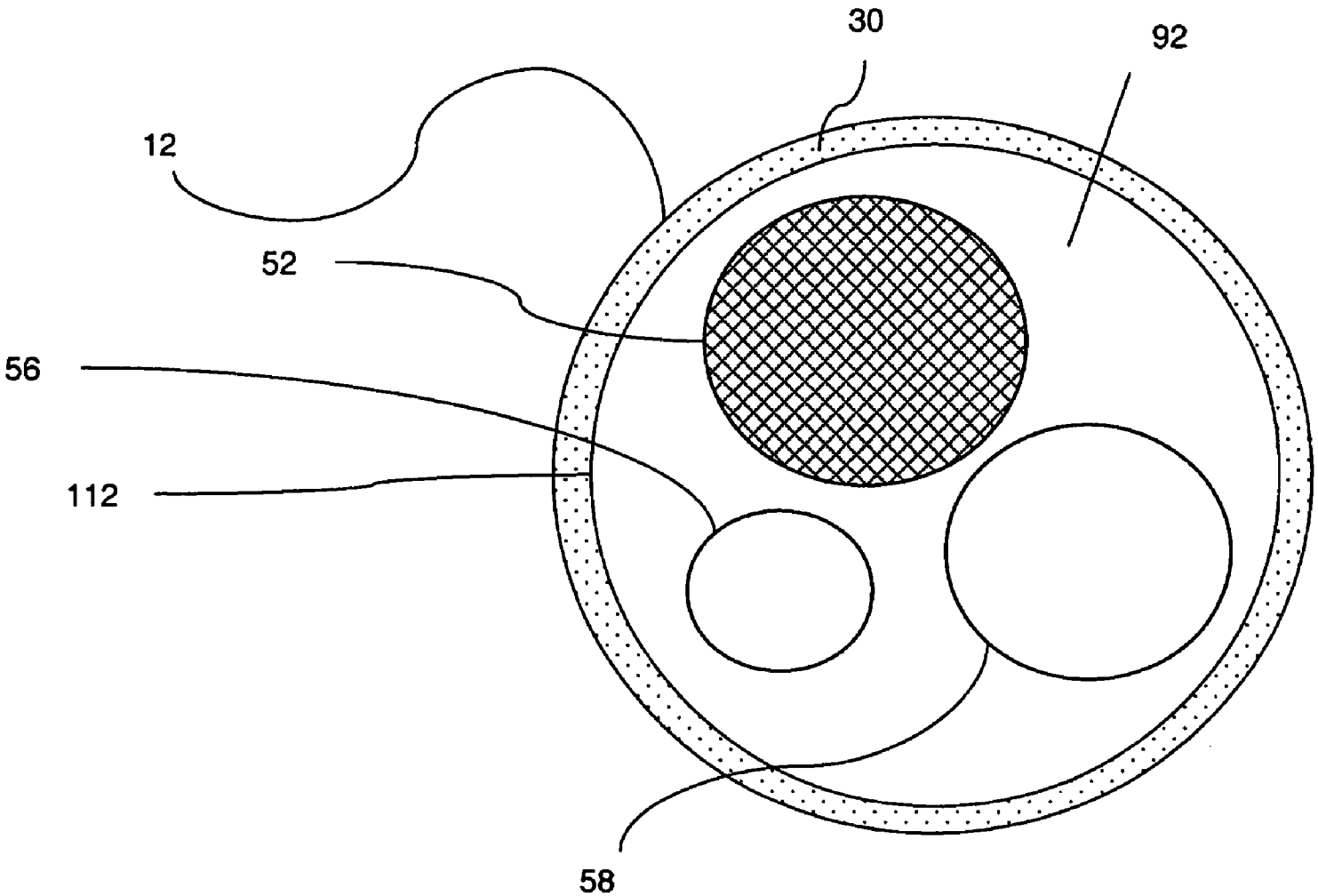
FIG. 7 shows a horizontal section through the middle of the first stage of the arrangement shown in FIG. 6.
Figure 8:
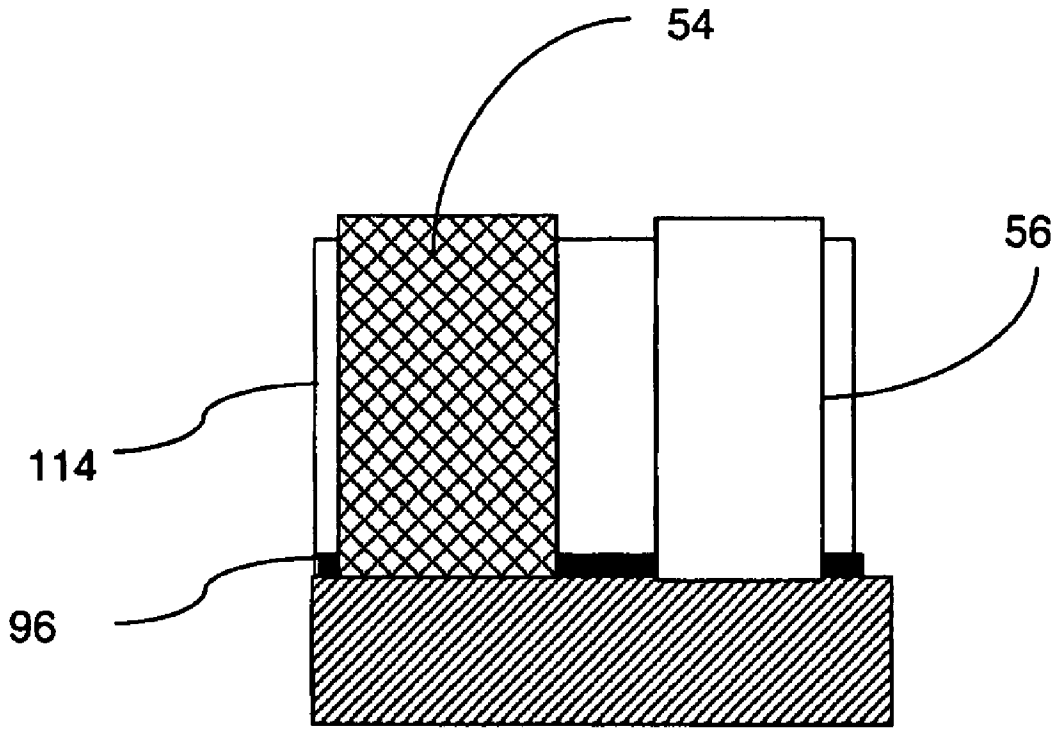
FIG. 8 shows a tube wall.

FIG. 7 shows a horizontal cut through the middle of the arrangement between the coldhead also known as the warm end, and the first stage. The pulse and regeneration tubes are indicated by reference numeral 52, 56, 58. The walls of the sleeves can be fabricated from thin gauge stainless tube (or other suitable materials like Titanium, composites like GRP, CFRP, possibly with metallic liners to make them diffusion proof against helium leakage). The volume 98 within inner sock 112 is evacuated thus avoiding any heat convection losses. The tube is joined by conventional joining techniques like welding or brazing 84 to flanges associated with the coldhead and first and second stages. FIG. 8 shows a section through the lower end of the second stage pulse and regeneration tubes 54, 56. A weld or brazed vacuum tight join is indicated at 96

Figure 9A:
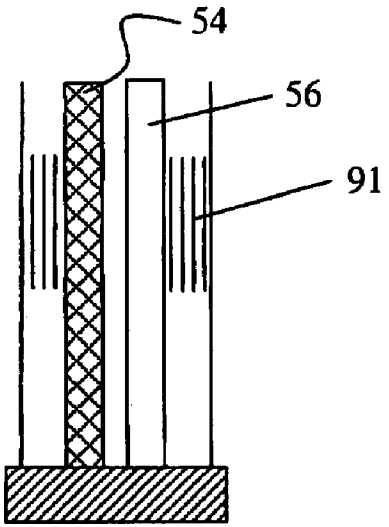
FIGS. 9A,B,C and D, show different mechanical forms of the vacuum sleeve.

The quality of the vacuum inside the sleeves 112, 114 can be enhanced by inserting getter materials, preferably at the cold end (e.g. activated charcoal, carbon paper etc, which can be wound around the tubes, zeolithes etc.). The insulation quality can be enhanced by placing Superinsulation™ foil 91 into the vacuum space, as shown in FIG. 9A.

The insulating space between the tubes is not evacuated in manufacture and air will be present. During cool down, the air will condense and eventually freeze towards the cold end of the coldhead (4.2 K). Getter materials can be placed within this environment and are particularly helpful to reduce the pressure of the atmosphere within the insulating space. Whilst the quality of the insulation is compromised to a certain extent, this is offset by the fact that no vacuum lines or vacuum processes are required reducing manufacturing costs.

Figure 9B:
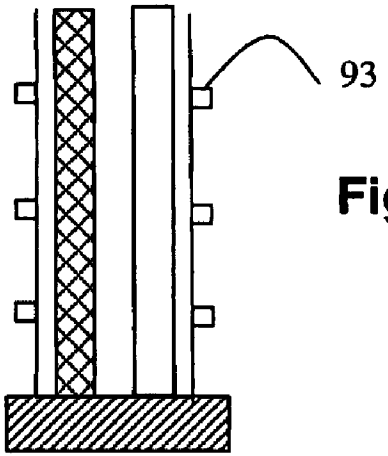
Figure 9C:
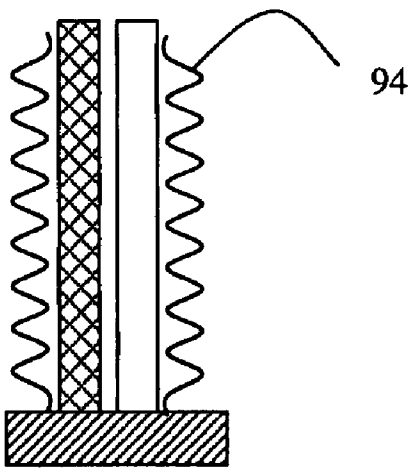
Figure 9D:
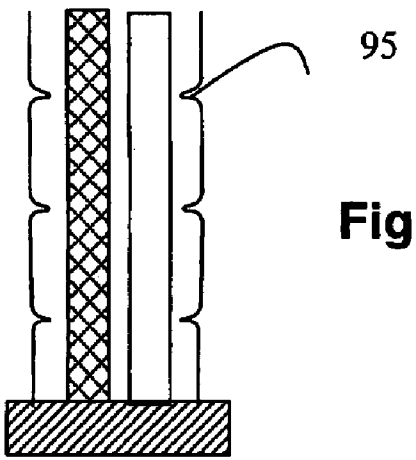

In FIGS. 9B, C and D, different mechanical forms of the vacuum sleeve are demonstrated. For improved clarity, the FIGS. show only the sleeve between the first and second stages. The wall thickness of the sleeve should be kept to a minimum, in order to reduce heat conduction. In order to avoid buckling under outside helium pressure (1 bar-3 bar typically during operational modes), it can be reinforced in several ways, typically by corrugation of the walls 93, 94 as shown in FIGS. 9B and C, although further strengthening means 95 may be provided as in FIG. 9D.

Figure 10B:
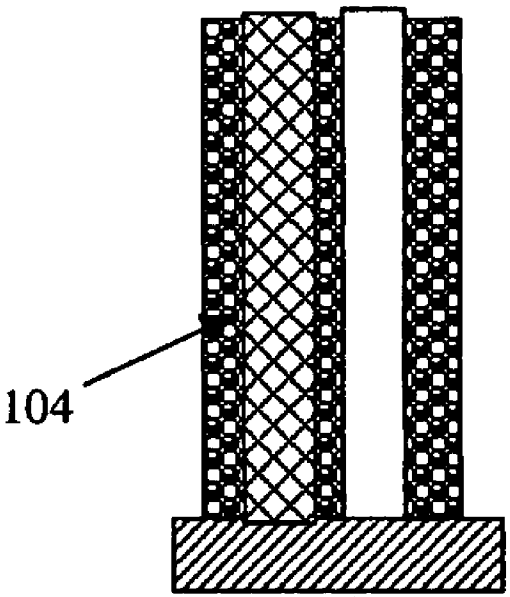
FIG. 10B shows a non-vacuum sleeve or low vacuum sleeve filled with loose insulation material.
Figure 10A:
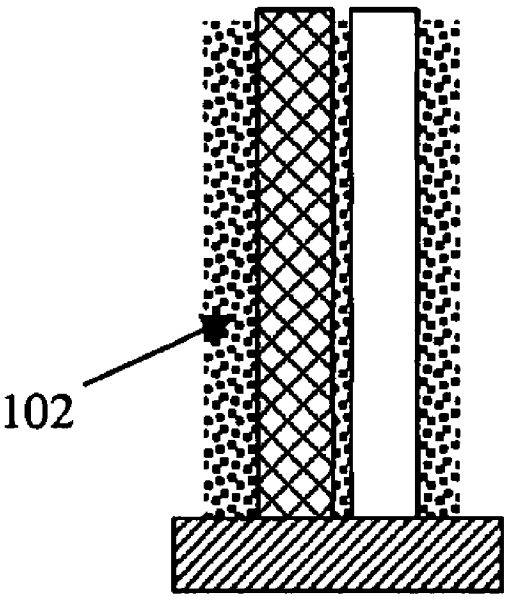
FIG. 10A shows pulse tubes and regenerator tubes enclosed in an integrated sleeve of insulation material.

Although not giving the same amount of insulation, non-vacuum insulation can be applied between the tubes in the same geometry as the vacuum sleeve. The placement of such fillings can provide a greater resistance to buckling. As illustrated in FIG. 10A pulse tubes and regenerator tubes can be enclosed by insulation material. Such as plastics foam 102, e.g. "Cryofoam" from Cryo-lite company, polyurethane foams, glass-fibre insulation, felts etc. Some foams can be expanded around the tube structure in situ. FIG. 10B shows a non vacuum sleeve or low vacuum sleeve is filled with loose insulation materials, e.g. powder insulation like perlite or hollow glass spheres 104, which can be internally evacuated or even covered with a reflective film, for example, of sputtered aluminium, to reduce radiation.

The insulation for individual tube can differ among each other, any combination of insulation and partial insulation can be applied. For example, the first stage can be covered with a vacuum insulation, the second with free-standing foam insulation. Also, in some applications it can be sufficient to insulate just the first stage or the second stage only.

While most applications at 4K operate with two stage coolers, the same technology can also be applied to single stage coolers or three and more stage coolers.

The invention claimed is:

1. A pulse tube refrigerator PTR arrangement within a cryogenic apparatus, wherein:

a PTR is operable within an insertion sock associated with a housing of the cryogenic apparatus, for positioning the PTR with a first end exposed to room temperature and a second end associated with a cryogenic fluid;

the insertion sock comprises an inner sleeve, and an outer sleeve, which is separable from the inner sleeve;

pulse and regenerator tubes of the PTR are surrounded by the inner sleeve;

space surrounding the tubes of the PTR within the inner sleeve is in a state of vacuum.

2. A PTR arrangement according to claim 1, wherein:

the PTR comprises two stages; and each sleeve is split into two parts, to separately insulate each stage.

3. A PTR arrangement according to claim 1, wherein only a small annular gap exists between the inner sleeve and outer sleeve.

4. A PTR arrangement according to claim 1, wherein the inner sleeve is fabricated from one of thin walled stainless steel tube, Titanium or composite materials.

5. A PTR arrangement according to claim 1, wherein the inner sleeve is fabricated from composites and is lined with metallic liners.

6. The pulse tube refrigerator according to claim 1, wherein:

the inner sleeve comprises a twin-walled sleeve.

7. A PTR arrangement according to claim 6, wherein the space between the walls of the twin-walled sleeve is evacuated.

8. A PTR arrangement according to claim 1, wherein the walls of the inner sleeve are corrugated.

9. A PTR arrangement according to claim 1, wherein the sock comprises a material selected from the group consisting of superinsulation, thinsulate and foam, and is placed around a rigid tube.

10. A PTR arrangement according to claim 6, wherein the PTR is associated with a magnetic resonance imaging apparatus.

11. A method of operating a pulse tube refrigerator PTR arrangement within a crvogenic apparatus, wherein the PTR is operable within an outer sleeve associated with a housing of the cryogenic apparatus, for positioning the PTR with a first end exposed to room temperature and a second end associated with a cryogenic fluid, wherein tubes of the PTR are disposed within and surrounded by a space that is delimited by an inner sleeve, the method comprising:

providing thermal insulation in said space that is delimited by the inner sock, surrounding tubes of the PTR, in a configuration that reduces heat losses from the tubes of the PTR:

wherein each of the outer sleeve and inner sleeve is split into two parts, and the outer sleeve and the inner sleeve are separable from each other.

12. A method of operatina a pulse tube refrigerator PTR arrangement within a cryogenic apparatus, wherein the PTR is operable within an insertion sock associated with a housing of the cryogenic apparatus, for positioning the PTR with a first end exposed to room temperature and a second end associated with a cryogenic fluid, wherein tubes of the PTR are disposed within and surrounded by a space that is delimited by an inner sleeve, the method comprising:

providing thermal insulation in said space that is delimited by the inner sleeve, surrounding tubes of the PTR, in a configuration that reduces heat losses from the tubes of the PTR; wherein:

the inner sleeve surrounds all the tubes of the pulse tube refrigerator; and a small annular gap is provided between an inner sleeve and outer sleeve of said inner sock.

13. The method according to claim 12, further comprising providing at least one of said inner sleeve and said outer sleeve in the form of a twin-walled sleeve.

14. The method according to claim 13, further comprising evacuating space between the walls of said twin-walled sleeve.

* * * * *